United States Patent [19]

Balaz

[11] 4,381,110

[45] Apr. 26, 1983

[54] GOLF TRAINER DEVICE

[75] Inventor: Anton Balaz, Altmünster, Austria

[73] Assignee: Plaspack Kunststoff GmbH & Co., KG, Schwanenstadt, Austria

[21] Appl. No.: 306,657

[22] Filed: Sep. 29, 1981

[30] Foreign Application Priority Data

Aug. 26, 1981 [DE] Fed. Rep. of Germany ... 8124914[U]

[51] Int. Cl.[3] ..... A63B 69/36

[52] U.S. Cl. ..... 273/182 R; 273/181 F

[58] Field of Search ..... 273/26 A, 181 F, 182 R, 273/182 A, 127 R, 398, 400, 401, 407, 411, 394, 396, 397

[56] References Cited

U.S. PATENT DOCUMENTS

| | | | |
|---|---|---|---|
| 2,805,070 | 9/1957 | Waters | 273/181 F |
| 2,915,314 | 12/1959 | Phillips | 273/26 A X |
| 3,390,882 | 7/1968 | Megerle | 273/182 R |
| 4,072,295 | 2/1978 | Roberts | 273/26 A X |

FOREIGN PATENT DOCUMENTS

| | | | |
|---|---|---|---|
| 408944 | 4/1934 | United Kingdom | 273/181 F |

*Primary Examiner*—George J. Marlo

*Attorney, Agent, or Firm*—Anthony A. O'Brien

[57] ABSTRACT

A golf trainer device is disclosed as including a frame defined by a pair of generally rectangular frame sections arranged in side-by-side vertical, upright positions with a rear hinge connecting the two sections and permitting folding thereof between a side-by-side position and a V-shaped position, connecting rods between the two frame sections for retaining the same in the V-shaped position; upper and lower horizontal flexible nets spanning the space between upper and lower portions of the two frame sections, respectively; a pair of vertical flexible nets, one attached to each frame section; a vertical flexible fabric sheet fixed to the horizontal nets intermediately between front and rear vertical legs of the frame sections so as to present an impact area for a driven golf ball; the flexible fabric sheet being made of a fabric stronger than the horizontal and vertical nets to absorb the impact of a driven golf ball; removable attachments for each connecting rod whereby the rods may be removed to permit folding of the two frame sections from the V-shaped position to the side-by-side position; a skirt portion on the lower horizontal net extending beyond the front vertical legs of the frame sections to facilitate return of a driven golf ball; the lower horizontal net being inclined downwardly toward the front vertical legs for returning a driven golf ball to the skirt portion; and, wherein the horizontal vertical nets are made of transparent material so that light may enter the device.

5 Claims, 1 Drawing Figure

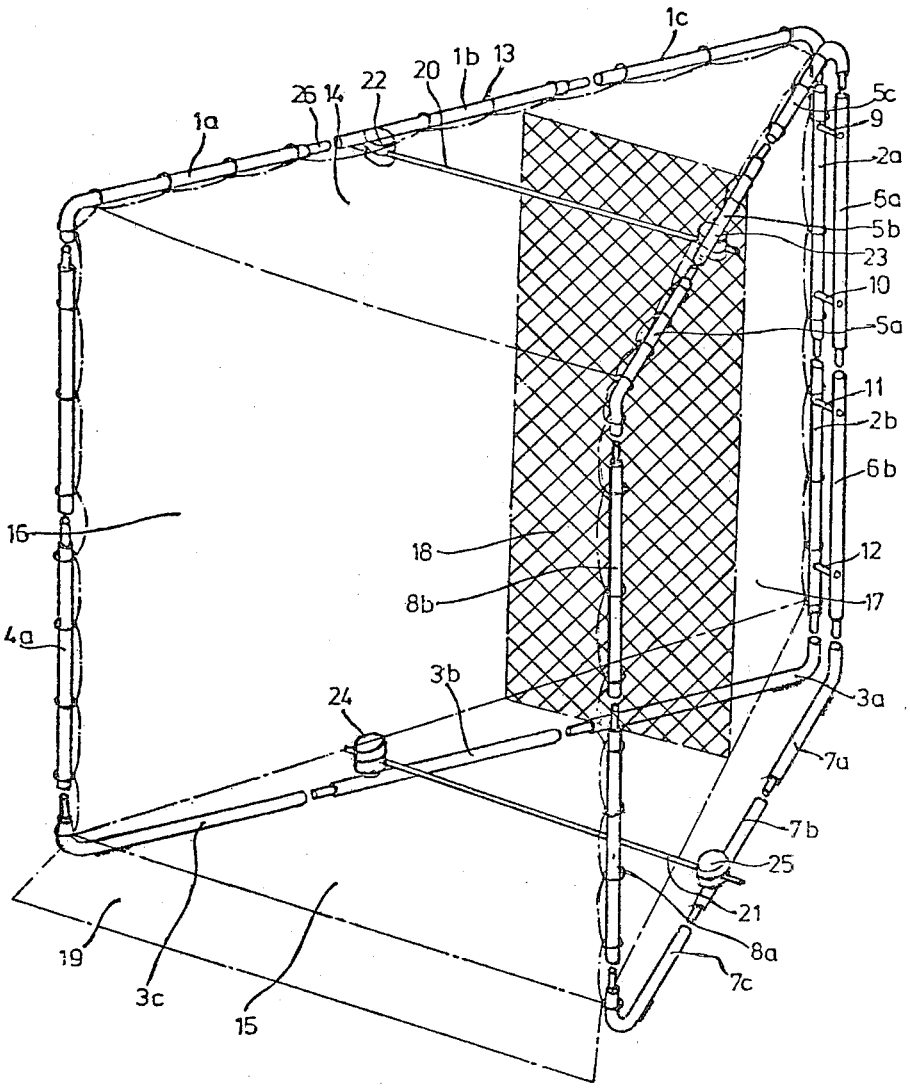
1c
1b
13
20
22
26
14
1a
5c
9
2a
6a
5b
23
10
5a
11
2b
6b
16
18
12
8b
17
4a
3b
24
3a
7a
7b
25
21
8a
7c
19
3c
15

GOLF TRAINER DEVICE

This invention relates to the golf trainer device and, more particularly, to such a device which is foldable and portable.

Basic to the present invention is construction of that device such that it can be folded together and set up again in a simple manner, providing the golf player with an opportunity when the device is set up, to aim his drive on the ball as if he were out on the course. The solution provided by the present invention is indicated by the features provided in the appended claims.

One embodiment is illustrated in the attached FIGURE.

The frame of the golf trainer device consists of two rectangular frame sections 1*a*-1*b*-1*c*, 2*a*-2*b*, 3*a*-3*b*-3*c*, 4*a*-4*b* and 5*a*-5*b*-5*c*, 6*a*-6*b*, 7*a*-7*b*-7*c*, 8*a*-8*b*, arranged in a vertical, upright position, vertical tubing 2*a*-2*b* and 6*a*-6*b* being connected while permitting vertical tubing 4*a*-4*b* and 8*a*-8*b* to be kept such a distance apart that the horizontal cross section of said arrangement is v-shaped. The vertical tubing sections 2*a*-2*b* and 6*a*-6*b* are connected by means of four transverse pins 9, 10, 11, 12. Rings 13 are pushed over the individual tubing pieces of the two rectangular frame sections, to permit suspension of the net. Having a large number of rings 13 ensures that the netting predominately assumes the v-shape of the frame. This net consists of two three-cornered net sections 14 and 15 filling the two v-shaped areas that emerge as two frame sections are pulled apart forming a wedge, and two rectangular net sections 16 and 17 completely filling the two rectangular frame sections. The three-cornered net sections 14 and 15 as well as the rectangular net sections 16 and 17 are sewn together along the outlines of the respective tubing sections thus forming a sack that tapers in the direction of vertical tubing sections 2*a*-2*b* and 6*a*-6*b*. Inserted to be in an upright, vertical position inside of the sack is the intercepting piece 18, cross hatched in the drawing, said piece extending in a direction symmetrical to the connected tubing sections 2*a*-2*b* and 6*a*-6*b* and joining the two three-cornered net sections 14 and 15 by being attached to the rectangular net sections 16 and 17. The intercepting piece 18 is manufactured of particularly hard wearing plastic fabric because it has to withstand the entire impact of a striking golf ball. In contrast thereto, the three-cornered net sections 14 and 15 and the rectangular net sections 16 and 17 can be made of lighter weight plastic fabric that transmits light so that the inside of the trainer device is always well lighted by daylight.

So that a golf ball caught by intercepting piece 18 will automatically be immediately released by the trainer device, the bottom three-cornered net section 15 is positioned such that it progressively slants downward as it extends from the inside toward the outside. Gravity would then immediately propel an intercepted ball out of the trainer device by means of the bottom three-cornered net section 15.

To prevent a golf ball from being driven underneath the bottom three-cornered section 15, that section is provided with an apron 19 extending to the ground, said apron attached to the bottom three-cornered net section 15 and extending toward the front and downward at an angle more steep than that of said three-cornered net section 15. A golf ball hitting apron 19 is prevented from getting beneath the bottom three-cornered net section 15. Optionally, the front edge of apron 19 can be fastened to the ground.

In order to provide the entire structure in its v-shaped formation with the stability needed, horizontal tubing sections 1*a*-1*b*-1*c* and 5*a*-5*b*-5*c* are provided with connecting rods 20 and 21 reaching across the outside of the three-cornered net sections 14 and 15. The two rods 20 and 21 are removably attached to the respective horizontal tubing sections by means of tensioning pieces 22, 23 and 24, 25. This permits removal of rods 20 and 21 after the tensioning pieces 22, 23 and 24, 25 are released, and folding up the two rectangular frame sections. The net can be removed from rings 13 beforehand, for example, by means of snap hooks and eyes etc. For this operation pins 9, 10, 11 and 12 are removed. The entire arrangement can be folded up still more by pulling the vertical tubing sections as well as the horizontal tubing sections apart. As the FIGURE shows, the horizontal and vertical tubing sections consist of pieces of tubing that fit one into the other in known fashion, for which purpose each tubing section is provided with a taper plug 26 that fits into the opening of the continuation piece of the tubing.

What is claimed is:

1. A golf trainer device comprising a frame having first and second generally rectangular sections made of tubing, each rectangular section having front and rear spaced vertical legs and upper and lower spaced horizontal legs, means defining plugs interposed between adjacent ends of each vertical leg and each horizontal leg permitting each rectangular section to be folded relative to each other, means defining transverse pins connecting the rear vertical legs in close proximity to each other, means defining rods attaching the upper horizontal legs to each other and the lower horizontal legs to each other at a horizontal distance greater than the rear vertical legs are to each other whereby the frame defines a generally wedge configuration, an upper horizontal flexible net attached to and extending across the space between the two upper horizontal legs, a lower horizontal flexible net attached to and extending across the space between the two lower horizontal legs, a vertical flexible net for each rectangular section attached to and extending across the space defined by the two horizontal legs and the two vertical legs of each rectangular section, a vertical flexible fabric sheet fixed to the upper and lower nets and to the two vertical side nets, said fabric sheet being located intermediately between the front and rear legs of the rectangular sections so as to present an impact area for a driven golf ball, and means defining a removable connection for said means defining rods whereby said means defining rods are removably attached to said horizontal legs permitting the frame to be folded with the two rectangular sections disposed adjacent each other.

2. The golf trainer device as claimed in claim 1 wherein said fabric sheet is made of a fabric stronger than the upper and lower horizontal nets and the two vertical side nets so as to absorb the impact of a driven golf ball.

3. The golf trainer device of claim 2 wherein said lower horizontal net includes a skirt portion extending beyond the front vertical legs to facilitate return of a driven golf ball.

4. The golf trainer device as claimed in claim 3 wherein said lower horizontal net is connected adjacent said pin means at a position above the lower horizontal legs to define a downward ramp and to permit a driven golf ball to return to the skirt portion.

5. The golf trainer device of claim 1, 2 or 4 wherein said upper and lower horizontal nets and said vertical nets are made of transparent material so as to transmit light inside of the golf trainer device.

* * * * *